United States Patent [19]

Oskam

[11] Patent Number: 4,928,744

[45] Date of Patent: May 29, 1990

[54] CLUTCH FOR A VERTICAL LOUVRE BLIND

[75] Inventor: Herman Oskam, Bergambacht, Netherlands

[73] Assignee: Hunter Douglas International N.V., Curacao, Netherlands

[21] Appl. No.: 580,679

[22] Filed: Feb. 16, 1984

[30] Foreign Application Priority Data

Aug. 16, 1983 [GB] United Kingdom ..... 8321980

[51] Int. Cl.[5] ..... E06B 9/38

[52] U.S. Cl. ..... 160/178.1; 160/177; 160/900

[58] Field of Search ..... 160/178 R, 166 A, 166 R, 160/168 R, 174, 177

[56] References Cited

U.S. PATENT DOCUMENTS 3,996,988 12/1976 de Wit ..... 160/168 R
4,293,021 10/1981 Arena ..... 160/178 R
4,306,608 12/1981 Frentzel et al. ..... 160/177 X
4,332,288 6/1982 Frentzel et al. ..... 160/176 R
4,335,775 6/1982 Frentzel et al. ..... 160/168 R X
4,350,197 9/1982 Haller ..... 160/166 A
4,381,811 5/1983 Frentzel et al. ..... 160/168 R

FOREIGN PATENT DOCUMENTS 2031493 4/1980 United Kingdom ..... 160/178 R
2036144 6/1980 United Kingdom ..... 160/166 A

*Primary Examiner*—David M. Purol
*Attorney, Agent, or Firm*—Pennie & Edmonds

[57] ABSTRACT

A clutch for a vertical louvre blind including an inner sleeve 20 mountable on a tilt rod 21 which is provided with longitudinally extending grooves 22. Keys 23 engage in the grooves 22 and the inner sleeve 20 is provided with three tongues 26 at the same circumferential location as the keys so that they can flex into the grooves 22. An outer sleeve 30 is provided with internal splines 32 engageable with a tooth 27 on each tongue.

10 Claims, 2 Drawing Sheets

CLUTCH FOR A VERTICAL LOUVRE BLIND

DESCRIPTION

The present invention relates to a clutch for a vertical louvre blind.

Such blinds include a headrail, travellers which can be moved along the headrail and hooks rotatably mounted in each traveller from which the louvres of the blind are suspended. The purpose of the traveller is twofold. It allows the louvres to be moved back, rather in the manner of a curtain, from an initial position in which the louvres all overlie a window. Secondly, the traveller has in it a mechanism for rotating the louvres so that the angle can be altered. It is advantageous for all the louvres to be parallel to one another and it is a conventional arrangement for each traveller to include a rotatable worm which engages with a worm wheel forming part of, or connected to the louvre hook. The worms are rotated by a common tilt rod which passes through all the travellers and is usually provided with longitudinal grooves which are engaged by keys of a rotatable sleeve which drives the worm, usually through a clutch. Two forms of clutch have been proposed, one in which teeth are provided in radial walls, to provide a face clutch, and others in which a tooth or teeth engages or engage radial splines on an outer sleeve. None of the present constructions is fully satisfactory insofar as they are rather cumbersome and relatively expensive to manufacture.

It is now proposed, according to the present invention, to provide a clutch for a vertical louvre blind traveller, said clutch comprising an inner sleeve, at least one key on the inner surface of the inner sleeve engageable in a groove in a tilt rod which passes through said sleeve, whereby the sleeve may be rotated thereby, at least one pair of slots each defining therebetween an axially extending tongue on said inner sleeve, an outer sleeve surrounding said inner sleeve, a worm forming element on the outer surface of the outer sleeve, a plurality of splines on the inner surface of said outer sleeve and means on the outer surface of the tongue engageable with the splines to cause rotation of the outer sleeve as the inner sleeve rotates, the or each tongue being at a circumferential location on the inner sleeve corresponding to a groove in said tilt rod, whereby the or each tongue can flex resiliently radially inwardly into said corresponding groove of said tilt rod, to allow continued rotating of said tilt rod and inner sleeve, if rotation of the outer sleeve is arrested.

The corresponding groove can be a specially formed groove or a groove designed to receive said key, to provide the drive connection between the tilt rod and the inner sleeve. With the latter construction, the key or keys would be mounted at the same circumferential location as the tongue or tongues. In either event, the tongues can readily flex into the corresponding groove or grooves of the tilt rod and can thus provide plenty of space for flexural movement. This means that the inner sleeve can be constructed so that it can be very thin indeed, making the whole assembly compact.

In a preferred construction the pair or pairs of slots extend from one axial end of the sleeve, whereby the or each tongue is mounted in cantilever fashion with respect to the remainder of the inner sleeve. Again this makes sure of a positive action with very light components.

Advantageously, the clutch further comprises a housing having opposite side walls with aligned openings formed therein and end portions on the inner sleeve engageable in said openings, so as to be rotatable therein, the outer sleeve being mounted within the housing, a radially outwardly extending annular, or part-annular, abutment formed on the outer surface of the inner sleeve at a location spaced from one end, one side of said abutment engaging the inner surface of one of said opposite walls of the housing and one end of the outer sleeve engaging the other side of said abutment. In this way the position of the outer sleeve with the worm mounted thereon, can be accurately controlled in a simple manner to provide a straight-forward bearing during the normal operation of the blind. Preferably the tongue or tongues extend to a point which is not axially beyond the location of the annular abutment so they do not reach beyond the end of the outer sleeve with engages the abutment.

The or each tongue may be provided with a radially outwardly extending tooth to engage in the splines to give good positive gripping action thereon.

In order that the invention may more readily be understood, the following description is given, merely by way of example, reference being made to the accompanying drawings, in which.

Figure 1:
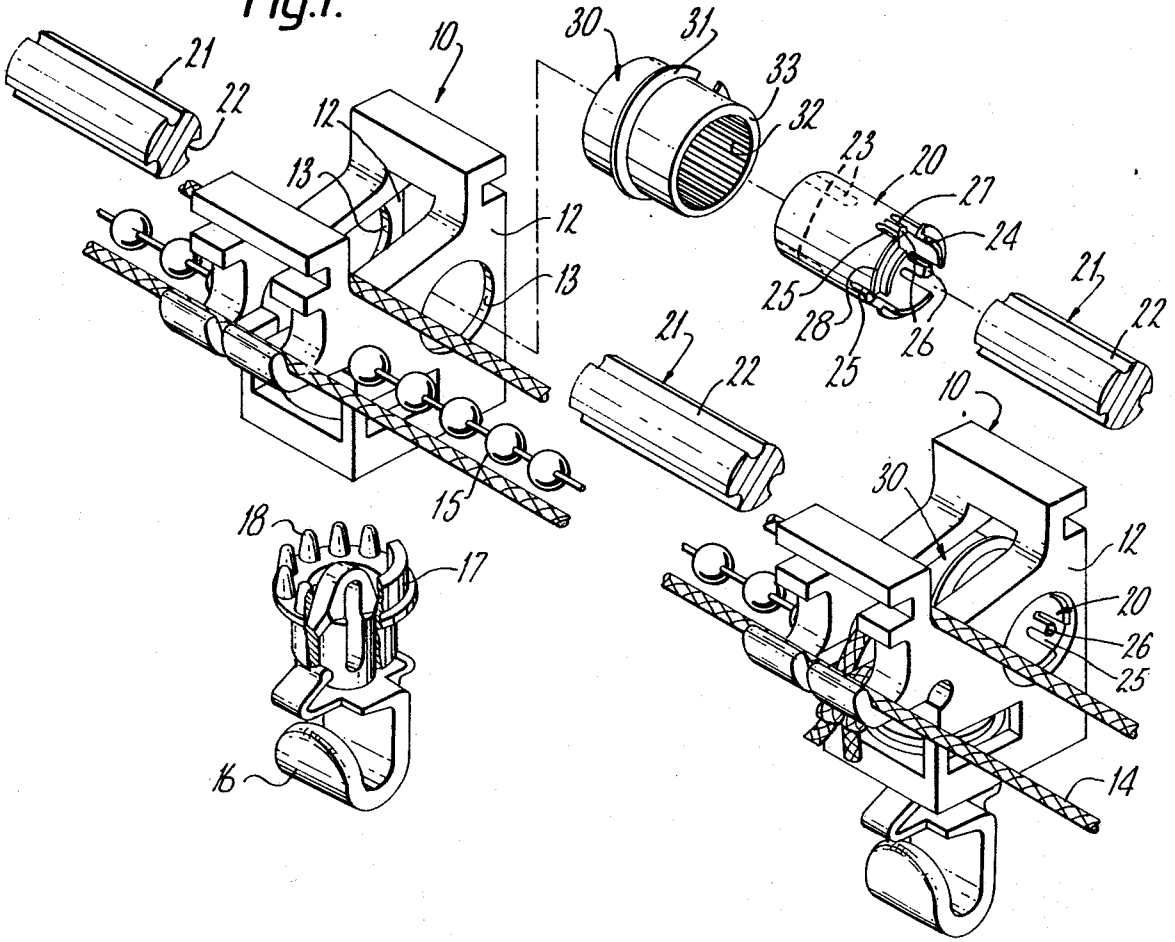
FIG. 1 is a perspective view showing one of the travellers of a vertical louvre blind exploded to illustrate the components parts forming one embodiment of clutch according to the invention, and an adjacent pair of travellers assembled.

Referring first to FIG. 1 there are illustrated two travellers 10 which are mounted for sliding motion in a headrail (not shown). Each traveller 10 includes side walls 12 with aligned openings 13 therein. Movement of the right hand of the carriers, as illustrated in the drawings, is effected by a pull cord 14 and movement to the right of the other traveller is effected by a ball chain 15. Each traveller has associated therewith a louvre hook 16 associated with a worm wheel 17 having upstanding teeth 18.

The lefthand traveller illustrated in FIG. 1 is shown as having the clutch mechanism of the present invention in an exploded state. This clutch includes an inner sleeve 20 which is a sliding fit over a tilt rod 21 which is provided with three equi-angularly spaced longitudinal grooves 22. The inner sleeve 20 has three equi-angularly spaced keys 23 fitting into the grooves, whereby rotation of the tilt rod 21 will cause rotation of the sleeve 20.

Extending from one axial end 24 of the inner sleeve are three equi-angularly spaced pairs of axially extending slots 25 defining therebetween three tongues 26 each of which is provided with a radially outwardly extending tooth 27. The outer surface of the sleeve is provided, at a location spaced a short distance from the end 24, with three part annular abutments 28. The length of the tongue 26 is such as not to extend beyond the abutment 28.

Surrounding the inner sleeve 20 is an outer sleeve 30 provided on its outer surface with a worm 31 and on its inner surface with longitudinally extending splines 32.

In the assembled condition the end 33 of the outer sleeve 30 abuts the abutment 28.

Figure 2:
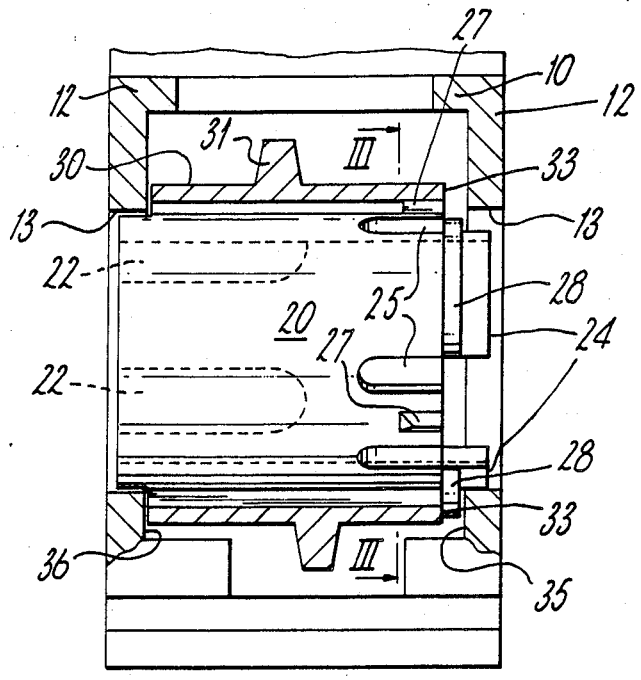
FIG. 2 is a partial cross-sectional elevation through a traveller to illustrate the clutch.

As can be seen in particular from FIG. 2, the whole clutch assembly can be pushed into the housing (by splaying of the side walls 12 thereof) so that the ends of the inner sleeve engaged in the openings 13 and the side walls 12 of the housing. At this time the outer surface of the abutment 28 engages against the inner surface 35 of one side wall 12. The length of the outer sleeve 30 is such that the other side of the outer sleeve engages against the inner surface 36 of the other side wall 12. In this way the inner and outer sleeves are both retained axially within the housing and are free to rotate.

Figure 3:
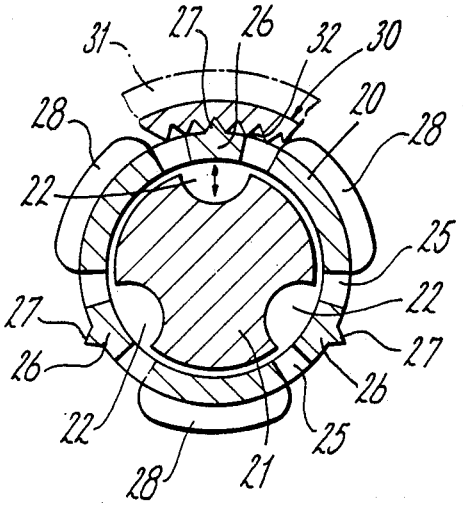
FIG. 3 is a section taken along the line III—III of FIG. 2.

It will be noted from FIG. 1 that the circumferential position of the keys 23 is the same as the circumferential position of the tongues 26, so that the tongues are located immediately above the grooves 22 in the tilt rod 21 as can be seen in FIG. 3. The teeth 27 on the tongues 26 engage in the spline 32 on the inner surface of the outer sleeve 30 so that the inner and outer sleeves will rotate together. Should the outer sleeve be arrested for any reason, then the tongue 26 can flex inwardly and allow slippage of the teeth 26 with respect to the splines 27. The positioning of the tongues over the grooves 22 greatly facilitates this operation.

It will be appreciated that all the parts can be simply moulded and the two parts of the clutch proper namely the inner and outer sleeves can readily be inserted one within the other and the thus formed assembly inserted in the housing 12.

I claim:

1. A clutch for a vertical louvre blind traveller, said clutch comprising an inner sleeve having an inner surface and an outer surface, at least one key on the inner surface of the inner sleeve engageable in a groove in a tilt rod which passes through said sleeve, whereby the sleeve may be rotated thereby, at least one pair of slots each defining therebetween an axially extending tongue on said inner sleeve said tongue having an outer surface, an outer sleeve having an inner surface and an outer surface surrounding said inner sleeve, a worm forming element on the outer surface of the outer sleeve, a plurality of splines on the inner surface of said outer sleeve and means on the outer surface of the tongue engageable with the splines effective to cause rotation of the outer sleeve as the inner sleeve rotates, said at least one tongue being at a circumferential location on said inner sleeve corresponding with a groove in said tilt rod, whereby said at least one tongue can flex resiliently radially inwardly into said corresponding groove of said tilt rod, effective to allow continued rotation of said tilt rod and inner sleeve if rotation of the outer sleeve is arrested.

2. A clutch as claimed in claim 1, wherein said at least one tongue is at the same circumferential location as said at least one key, whereby said at least one tongue can flex resiliently radially inwardly into the groove engaged by said key.

3. A clutch as claimed in claim 1, wherein said at least one pair of slots extend from one axial end of the sleeve, whereby said at least one tongue is mounted in cantilever fashion with respect to the remainder of the sleeve body.

4. A clutch as claimed in claim 1, and further comprising a housing having opposite side walls with aligned openings formed therein and end portions on the inner sleeve engageable in said openings, so as to be rotatable therein, the outer sleeve being mounted within the housing, a radially outwardly extending annular, or part-annular, abutment formed on the outer surface of the inner sleeve at a location spaced from one end, one side of said abutment engaging the inner surface of one of said opposite walls of the housing and one end of the outer sleeve engaging the other side of said abutment.

5. A clutch as claimed in claim 4, wherein said at least one tongue extends to a point which is not axially beyond the location of said annular abutment and thus not be on said one end of the outer sleeve.

6. A clutch as claimed in claim 4, wherein the outer sleeve is of such an axial length for the other end of the outer sleeve to engage the inner surface of the opposite side wall.

7. A clutch as claimed in claim 1, wherein said at least one tongue is provided with a radially outwardly extending tooth to engage said splines.

8. The clutch according to claim 3 wherein said cantilever extends parallel to the groove.

9. A clutch for a vertical louvre blind traveller, said clutch comprising an inner sleeve having an inner surface and an outer surface, at least one key on the inner surface of the inner sleeve engageable in a groove in a tilt rod which passes through said sleeve, whereby the sleeve may be rotated thereby, at least one pair of slots each defining therebetween a flexible tongue on said inner sleeve said tongue having an outer surface, an outer sleeve having an inner surface and an outer surface surrounding said inner sleeve, a worm forming element on the outer surface of the outer sleeve, a plurality of splines on the inner surface of said outer sleeve and means on the outer surface of the tongue engageable with the splines effective to cause rotation of the outer sleeve as the inner sleeve rotates, said at least one tongue being at a circumferential location on said inner sleeve corresponding with a groove in said tilt rod, whereby said at least one tongue can flex resiliently radially inwardly into said corresponding groove of said tilt rod, effective to allow continued rotation of said tilt rod and inner sleeve, if rotation of the outer sleeve is arrested.

10. The clutch according to claim 9 wherein said tongue extends axially.

* * * * *

UNITED STATES PATENT AND TRADEMARK OFFICE

CERTIFICATE OF CORRECTION

PATENT NO. : 4,928,744

DATED : May 29, 1990

INVENTOR(S) : Herman Oskam

It is certified that error appears in the above-identified patent and that said Letters Patent is hereby corrected as shown below:

On Title Page:

Please change the Assignee's address from "Curacao, Netherlands" To --Curacao, Netherlands Antilles--.

Signed and Sealed this

Thirteenth Day of August, 1991

*Attest:*

HARRY F. MANBECK, JR.

*Attesting Officer*

*Commissioner of Patents and Trademarks*